US010961106B2

(12) United States Patent
Lawler et al.

(10) Patent No.: US 10,961,106 B2
(45) Date of Patent: Mar. 30, 2021

(54) METHOD AND SYSTEM FOR DISPENSING CARBONATED BEVERAGES AT INCREASED SPEED

(71) Applicant: QualFlow Systems Limited, Dublin (IE)

(72) Inventors: Justin Lawler, Louth (IE); Ciaran O'Morain, Dublin (IE); Ultan O'Morain, Dublin (IE)

(73) Assignee: QualFlow Systems Limited, Dublin (IE)

( * ) Notice: Subject to any disclaimer, the term of this patent is extended or adjusted under 35 U.S.C. 154(b) by 0 days.

(21) Appl. No.: 16/305,541

(22) PCT Filed: Jun. 2, 2017

(86) PCT No.: PCT/EP2017/063516
§ 371 (c)(1),
(2) Date: Nov. 29, 2018

(87) PCT Pub. No.: WO2017/207779
PCT Pub. Date: Dec. 7, 2017

(65) Prior Publication Data

US 2020/0055722 A1 Feb. 20, 2020

(30) Foreign Application Priority Data

Jun. 3, 2016 (GB) ..... 1609733

(51) Int. Cl.
*B67D 1/14* (2006.01)
*B67D 1/12* (2006.01)
*B67D 1/04* (2006.01)

(52) U.S. Cl.
CPC ..... *B67D 1/1272* (2013.01); *B67D 1/0406* (2013.01); *B67D 1/1213* (2013.01); *B67D 1/1218* (2013.01); *B67D 1/1247* (2013.01); *B67D 1/1411* (2013.01); *B67D 2210/00049* (2013.01); *B67D 2210/00099* (2013.01)

(58) Field of Classification Search
CPC .. B67D 1/1272; B67D 1/1411; B67D 1/1247; B67D 1/1218; B67D 1/1213; B67D 1/0406; B67D 2210/00099; B67D 2210/00049; B67D 1/0888; B67D 1/127; B67D 1/1202; G05D 7/00
See application file for complete search history.

(56) References Cited

U.S. PATENT DOCUMENTS 5,335,705 A * 8/1994 Morishita ..... B67D 1/04 141/104
5,730,323 A 3/1998 Osborne

FOREIGN PATENT DOCUMENTS

| | | |
|---|---|---|
| DE | 2147274 | 5/1985 |
| DE | 4222424 | 4/1993 |
| DE | 202011005171 | 8/2011 |
| EP | 0861801 | 9/1998 |

* cited by examiner

*Primary Examiner* — Jason K Niesz
(74) *Attorney, Agent, or Firm* — McCracken & Gillen LLC

(57) ABSTRACT

A system for dispensing beverages into a receptacle controls both the dispense flow rate of a carbonated beverage and also uses bottom filling of the receptacle to limit entrainment and bubble formation during the dispense process. More particularly, the present application provides for using two separate flow paths for dispensing beverage with a first path employed initially for a low flow rate and a second path employed thereafter to fill the receptacle.

22 Claims, 6 Drawing Sheets

METHOD AND SYSTEM FOR DISPENSING CARBONATED BEVERAGES AT INCREASED SPEED

FIELD OF THE APPLICATION

The present application relates generally to beverage dispensing systems and more particularly to methods of dispensing carbonated beverages at higher than normal speeds.

BACKGROUND

Systems for dispense of beverages may be considered to consist of three main parts. The first part is a storage container or reservoir for storing the beverage. These storage containers when used in the context of alcoholic drinks, for example beer, are often referred to as a keg. These kegs are typically located in a storage area, cold room or cellar. Secondly a beverage transport system is used to convey the beverage to a dispense location, for example a bar, through pipes or lines. Thirdly, a dispenser, commonly referred to as a tap, delivers beverage from the pipes\lines into a container, e.g. a glass, for consumption. Although usage varies, pipes are generally rigid whereas lines are taken to be flexible. In practise, a system may employ a combination of both. In the present application, the term conduit is employed and may be taken to include both rigid pipework and flexible lines or hoses.

A beverage dispensing system may also have additional components for example to cool the beverage and provide insulation of the cooled beverage in the dispense lines as the beverage is conveyed to the dispenser.

Installations of beverage dispensing systems vary but a common installation might typically position the beverage storage containers in a chilled storage area or cellar. The beverage may then be additionally cooled in proximity to the storage area before being transported to the dispense location.

Alternative installations may provide the additional cooling of the beverage in proximity to the dispense location. Another possibility is to not use a chilled storage area but to transport the beverage from the storage container at ambient temperature before cooling the beverage in proximity to the dispense location.

FIG. 1 shows an exemplary beverage dispense system. The beverage dispense system comprises a plurality of beverage storage containers 1, located in a beverage storage area, cold room or cellar 2. The beverage transport system typically comprises a number of beverage conduits 5 which may be a combination of pipes or hoses, FOB detectors 3 and one or more beverage chillers 7. Each beverage conduit 5 is connected to a corresponding storage container by a connector 9, commonly referred to as a "dispense head" for carbonated beverage products. Other components may be included as required by the application or specific installation. The beverage lines\pipes may be insulated in regions 6 in order to maintain the temperature of the beverage during its time in the transport system. Beverage is served from a beverage tap 8 in a location remote to the beverage dispense system, e.g. a bar area 4.

Beverages are typically dispensed from the storage container by means of gas pressure which pushes the beverage out of the container and into the beverage dispense lines. The beverage containers are configured so that liquid is dispensed from the bottom of the container so the addition of pressurised gas above the level of the liquid forces the beverage out of the container. Gas enters the storage container through the dispense head 9 and is supplied from a source of pressurised gas 10 through a gas delivery conduit 11. Additionally pumps may be used to pump the beverage through the beverage dispense lines. Some beverages which do not use gas pressure may only use pumps to draw beer from the container to the beverage tap. The flow rate at which beverage is dispensed from the dispense systems is determined by the gas pressure or pump assistance applied, the frictional resistance of the beverage conduit and its components as well as any vertical distance between the storage area and the dispense point. As storage containers empty, gas can enter the beverage dispense line and potentially travel up the line to the dispenser. For beverages which are carbonated i.e. contain dissolved gas, this can result in loss of beer due to the formation of foam or FOB (foam on beer) when beverage is reintroduced into the dispense line. FOB is unsuitable for consumption and is therefore wasted. To stop this occurring beverage lines are typically fitted with a device 3 to stop gas ingression into the beverage dispense lines. These devices are commonly referred to as FOB detectors and typical examples include UK patents GB1, 357,953 or Porter Lancastrian, GB2,286,581 of Francisco Moreno Barbosa and U.S. Pat. No. 5,564,459. They are typically configured as a liquid filled chamber that is positioned near the start of the beverage dispense line. Beverage enters the chamber near the top and exits near the bottom of the fob detector 3. A buoyant float in the chamber rises to the top when the chamber is filled with liquid and lowers as the liquid level drops when gas is introduced. As the liquid level drops the float drops into and seals a valve of the chamber preventing further gas ingress into the beverage dispense lines. When the float seals the outlet of the FOB and the dispense tap remains open, the pressure in the dispense conduit downstream of the fob drops. Other fob detectors are known which operate indirectly. These indirect fob detectors use a sensor to determine the position of the float in the chamber and actuate a separate valve in the dispense conduit, to control the flow of beverage when the position of the float has been detected as having fallen to a particular level. These are commonly referred to as electronic FOBs. UK patent GB2,404651 is an example of this system. The separate valve may by placed in proximity to the fob or at some remote location in proximity to the dispense point.

Other devices such as flow controllers may also be placed at or in the vicinity of the beverage dispense tap 8. These are used to control the maximum flow delivered through the beverage dispense conduit 5 and thus through the tap. These are typically adjustable and are set so that the flow rate from the beverage dispense tap is set to be below a speed that produces excessive bubble and foam formation.

Beverages are typically supplied in a carbonated form with a specified amount of dissolved gas in the beverage. The dissolved gas is typically Carbon Dioxide ($CO_2$) or a mixture of $CO_2$ and Nitrogen ($N_2$).

Gasses can dissolve in liquids. The amount gas dissolved in a liquid is dependant on the solubility of the gas at the surface between the liquid and the gas, the pressure or partial pressure of the gas and the temperature of the liquid. The concentration of gas dissolved in a liquid is governed by Henry's law, which states that in equilibrium the partial pressure of a given gas above a solution is proportional to the concentration of the gas dissolved into the solution.

Typically the amount of gas dissolved in a beverage is referred to as carbonation even though it may refer to both $CO_2$ and $N_2$. Beverages are placed in storage containers in a carbonated form. The pressure level and mixture of the gas supplied to the storage containers is typically set to provide maintain a specific level of carbonation in the dispensed product. Typically in the beverage storage container any space not taken up with liquid is filled with gas at above ambient pressure. The gas dissolved in the beverage and the gas in the unfilled space of the beverage storage container is in equilibrium for a given temperature.

When the beverage storage container is connected to a dispense system, gas can enter the storage container above the level of the liquid through the dispense head. This additional gas is typically referred to as 'dispense gas'. The dispense gas is typically maintained at constant pressure known as 'top pressure'. The dispense gas has three main purposes. Firstly it provides pressure to force the beverage from the bottom of the beverage storage container up the beverage dispense system. Secondly as beverage is removed from the storage container and the liquid level drops, additional dispense gas fills the space taken up by the displaced liquid and maintains a constant beverage pressure for the dispense system. Finally the gas or gas mixture used for the dispense gas maintains the equilibrium concentrations of gas dissolved in the beverage. This is particularly important when a beverage storage container may be connected to a beverage dispense system for a prolonged period before it is emptied. The top pressure and gas mix are typically set to provide a specified level of carbonation in the beverage for given storage conditions. The beverages in the storage containers are considered to be in a supersaturated state with respect to the dispense gas.

As stated previously for carbonated beverages the dispense gas is typically $CO_2$ or a mixture of $CO_2$ and $N_2$. Nitrogen has approximately $1/50^{th}$ the solubility in beverages as $CO_2$. When used in addition to $CO_2$ it allows higher top pressures to be used with minimal additional gas becoming dissolved in the beverage. This gives greater flexibility when operating the dispense system as the minimum flow rates required for dispense can be maintained over longer distances and with narrower diameter conduits than when using only $CO_2$ gas. In addition the need for additional pump means may also be removed. The use of mixed gas affects taste and flavour by firstly altering the level of dissolved $CO_2$ in the beverage, which forms carbonic acid when dissolved. Secondly it affects the bubble size when beverages are dispensed.

Beverage storage containers are typically contained in a temperature controlled area or cellar. These are typically but not always at a higher temperature than the final dispense temperature. After exiting the beverage storage container the beverage is typically cooled further before final dispense. This is achieved using a cooling means placed along the beverage conduit. These typically consist of a stainless steel length of the beverage conduits submerged in ice water (0° C.) or encased in an aluminium plates cooled by a glycol/water mixture, the latter are commonly referred to as chiller plates. After cooling the beverage the gas dissolved in the beverage is in an unsaturated state for the given pressure applied to it. As mentioned previously the use of pumps to dispense the beverage along the beverage conduit also increases the pressure applied to the liquid and likewise the beverage becomes an unsaturated liquid/gas mix.

Carbonated beverages are typically dispensed with a valve means or tap placed at the outlet of the beverage conduit. When the tap is closed the entire length of volume of liquid contained in the beverage dispense conduit is subject to the dispense pressure in the beverage storage container or pump (if used). Changes in height affect this depending on the elevation of the conduit from the dispense container or pump. When the tap is opened and liquid flows the pressure applied to the liquid becomes the dynamic pressure and varies depending on the location along the beverage conduit.

When carbonated beverages are dispensed and the applied pressure above ambient is removed, the beverage becomes supersaturated with respect to the dissolved gas. The $CO_2$ concentration in the liquid is no longer in equilibrium with the concentration in the atmosphere at the surface. The beverage enters a metastable state where the amount of $CO_2$ is in excess of what would be expected from Henry's Law. In order to return to equilibrium the excess dissolved gas evolves from the liquid by either diffusion at the liquid/atmosphere surface or though bubble formation.

The spontaneous and homogeneous formation of bubbles is uncommon in dispensed beverages. The nucleation of bubbles that spontaneously form in the liquid or from a smooth surface and grow beyond a critical radius is energetically very unfavourable. Bubble formation actually occurs by two primary mechanisms. Firstly, bubbles form in nucleation sources in pre-existing gas cavities and secondly through entrainment during the process of dispensing the beverage into a container.

Bubble forming gas cavities must be larger than a critical radius to act as nucleation sites and they can take the form of scratches or concave imperfections in surfaces or they may also be hollows on particulates suspended in the liquid. These physical forms significantly reduce the energy required for bubble formation. In addition the critical radius for bubble formation is also dependant on the concentration of dissolved gas in the liquid, with lower concentrations requiring gas cavities with larger critical radii.

Bubbles that form at nucleation sites grow as gas diffuses into them from the surrounding liquid. When the bubble reaches a critical size its buoyancy becomes great enough to allow it to detach from the nucleation site and another bubble starts to grow. When beverage is flowing across a surface this critical size is reduced as the motion of the liquid mechanically removes the bubble at a smaller size. Higher velocities remove bubbles at smaller sizes resulting in a larger number of bubbles being created. Suspended in the liquid bubbles continue to grow until they burst when reaching a surface. This type of bubble nucleation at gas cavities is typically referred to as heterogeneous nucleation. For beverages this type of gas bubble creation can occur from the initially dry surfaces of the beverage receptacle as the beverage is dispensed and flows over it. For this reason receptacle materials such as glass or plastics are preferably smooth in order to minimize this process. Bubble formation may also occur from parts of the dispense system, including the outlet of the dispense tap and also the region upstream of the dispense tap which experiences a drop in static pressure after the dispense tap has been opened. Higher liquid velocities produce more bubbles and these effects are increased if they are high enough to produce turbulent flow within the beverage conduit.

Entrainment of bubbles occurs when liquid is dispensed into a beverage receptacle and the liquid stream contacts turbulently, and mixes with, the liquid in the container. Bubbles become entrapped and enter the liquid. In the case of beverage these entrained bubbles provide surfaces for the diffusion of gas from the liquid and growth of the bubble.

Typically beverage dispense taps are manual valves operated by means of a handle or lever. The beverage is directed into the receptacle by a spout of spout. One of the limitations of this type of dispense is that the dispense speed is constrained by the need to limit the amount of bubble formation as this can give rise to excess foam on the beverage. Typically beverage dispense taps incorporate a mechanical means to control the maximum flow of beverage through the tap. Typically these flow controllers are in proximity to the beverage tap of may be incorporated within them (e.g. U.S. Pat. Nos. 5,368,205 7,513,398). These are typically only adjusted infrequently to provide a desired predetermined flow rate.

A major limitation on the speed with which beer can be dispensed is the formation of bubbles and therefore foam during the dispense process. This produces excess waste of the beverage as the foam is poured away to fill the receptacle with liquid beverage One simple method is to further cool the beverage below its normal dispense temperature. This increases the stability of the absorbed $CO_2$ and makes it less likely to form a large numbers of bubbles. The disadvantage is that customers may find the beverage to be too cold and with an altered flavour because of this.

A number of approaches have been used to try and address the problem of bubble and foam formation and these in practice primarily rely on two main approaches.

Firstly, by minimising entrainment and turbulence caused by the entry of the beverage stream being dispensed into the receptacle. Typically this is done by immersing the end of the dispense tap spout into the liquid being dispensed. This eliminates entrainment once the orifice in the spout has become immersed and also minimises the flow of beverage over the receptacle walls and the formation and mechanical removal of bubbles from nucleation sites on them. These arrangements are generally identified as being of the type known as bottom filling since the tap spout extends substantially into the beverage receptacle and thus the liquid flows from the bottom upwards.

In contrast, top filling is where the beverage exits from the spout and falls under gravity from the spout at or close to the top of the receptacle to the bottom.

The second method, bottom filing, actively controls the rate of flow during the dispense process. Typically these methods start the dispense process with a slower dispense speed until the spout orifice is immersed, thereafter the flow rate is increased to higher value for the rest of the dispense volume.

There are number of examples of devices that immerse the end of the spout in the dispensed beverage. Once the orifice in the end of the spout is covered in liquid no further entrainment can take place and the flow of liquid along the surface of the receptacle is eliminated. U.S. Pat. Nos. 7,040,4359, 7,278,454 are examples of this approach and uses an extended spout which attaches to an existing beverage dispense tap.

Another approach is exhibited by EP2883833. In this example the valve is placed at the bottom of the spout and it is activated by pushing the valve actuator against the bottom of the beverage receptacle. One disadvantage of this approach is that the valve is a direct acting mechanism and therefor the force applied to open it is directly proportional to the size of the valve opening. This for practical purposes limits the size of the valve orifice as a larger opening or increased dispense pressure requires increased force to open the valve. Therefor the velocity of the liquid that can be delivered through it without producing excessive bubbles is also limited More complex devices such as detailed in U.S. Pat. Nos. 8,833,405, 7,861,740 and EP1099661 use an adjustable flow control device along with flow measurement and a digital microcontroller to control the beverage dispense. The flow control device is positioned upstream of the dispense spout and is typically configured to move between two positions, a "slow flow" position and a "fast flow" position. The valves and flow controller are placed in series with each other and beverage flows sequentially through the different components. The beverage dispense is controlled by the digital microcontroller to dispense a predetermined portion of beverage. Though actual implementations may vary, in general these devices work by first setting the flow controller in a "slow flow" position before opening the valve at the end of a spout when it is positioned in the bottom of a beverage receptacle such as a glass. Once a predetermined volume of beverage has been dispensed (the spout becomes immersed) the flow controller is adjusted to increase the flow of beverage to a "fast flow" position. Once a portion size has been dispensed the spout valve closes and the flow controller reverts to its "slow flow" position.

Other arrangements including GB2176766, EP1138628 and U.S. Pat. No. 7,815,078 operate to initially fill a glass with beer and then switch to a second dispensing method for placing foam on top of the beer.

The present application is directed at an improved beverage dispense system. More particularly, the present is directed at providing a convenient system for dispensing beverages with an improved speed of dispensing.

SUMMARY

Accordingly, the present application provides a beverage dispense device which both controls the dispense flow rate of the carbonated beverage and also uses bottom filling of the receptacle to limit entrainment and bubble formation during the dispense process.

The application comprises the use of a valve arrangement in combination with two parallel fluid paths to control the beverage dispense. The two parallel paths bifurcate at a node upstream of the valve arrangement and rejoin downstream or have separate outputs at the spout.

A first valve and fluid path may be configured to provide a slow flow dispense. A second valve and fluid path may be configured to provide a higher flow dispense.

The two paths may be used in combination with a dispense spout that suitable reaches the bottom of the beverage receptacle to fill a beverage receptacle.

Both valves may be used in combination with a flowmeter to measure the dispense volume and a microcontroller to control the dispense process.

On activation the microcontroller suitably first opens the first slow flow valve for a predetermined slow dispense volume. When this is reached the second high flow valve is also opened. On reaching a predetermined dispense volume both valves are closed. The slow dispense volume is configured to eliminate any air from the spout and spout and suitably immerse the dispense spout in liquid before the fast dispense is activate. The device can be configured to dispense different portion sizes in response to different selections or inputs of switches or buttons by an operator.

The application also provides for the slow dispense volume to be varied according to different factors such as the time since the last dispense was activated or whether a beverage storage container has been changed.

The application also provides for a simple calibration method whereby the operator configures the dispense font into a calibration mode. A first activation of a portion button or switch opens the slow dispense valve. When a suitable slow dispense volume has entered the beverage receptacle a second activation of the portion button or switch opens the fast dispense valve. When the desired portion size has been dispensed a third activation of the portion switch or button closes both valves. The microcontroller records the corresponding flowmeter volumes measured for the slow dispense volume and the total dispense volume and assigns these to the dispense process of the corresponding portion switch or button.

The application also provides for the dispense device to operate in cooperation with an electronic FOB such that a signal from the electronic FOB indicating that the sensor has detected that a beverage storage container has emptied causes the dispense device to close the valves and cease dispensing. The dispense device may visually indicate to the operator that the beverage storage container is empty. This has the advantage that the beverage in the beverage conduit remains pressurised and limits the possibility of gas bubbles nucleating. Likewise when not operating in cooperation with an electronic FOB, but with a normal FOB, the microcontroller is configured to require a minimum flow rate measurement from the flowmeter during the dispense process. If this flow rate is not maintained during a specified time period then the valves close and dispense is stopped. For example when the float drops in a FOB and seals the outlet of the FOB chamber this will be detected by the dispense device.

Further embodiments are set out specifically in the claims, which follow. Additional embodiments, features and advantages will become apparent from the detailed description and the drawings which follow, in which:

DESCRIPTION OF DRAWINGS

For convenience, the same reference numerals are used with like features between the figures in the drawings.

DETAILED DESCRIPTION

The present application provides for the dispensing of carbonated beverages with an increased speed over conventional manual beverage tap dispensing arrangements. In addition certain arrangements offer the ability to dispense predetermined portions from a robust, reliable and simple device. Each of these factors is important in an industry where historically there is only simple manual dispense and there are correspondingly less technically proficient operator, install and support services. The present application provides a faster dispense device which uses bottom filling of a beverage receptacle, which may for example be a glass, mug, stein, jug, pitcher or other suitable container in which beverages are provided to customers in a bar or similar venue.

The application provides a means of controlling the flow rate of beverage during the dispense process. The dispense process comprises the steps of providing a slow dispense speed during a first part of the dispense process until the dispense spout is suitably immersed in the beverage. The method then switches to a higher dispense speed for the remaining portion of the dispense portion volume.

Previous devices that use both bottom filling of a beverage receptacle and flow control have typically employed complex devices to actively control the flow rate of the beverage as it passes though a single beverage pathway to the dispense spout. Aside from the complexity of the devices, a further problem is that they tend to produce excessive bubbles requiring additional cooling to counter their effects.

The present application avoids these limitations of existing solutions by splitting the beverage flow pathway at a node. Suitably, this split is into two separate dispense pathways but there may be more.

A first pathway is configured to provide a slow dispense speed and a second pathway a fast dispense speed. It will be appreciated that fast dispense speed and slow dispense speed are relative to each other. The flow in each of these two pathways or conduits is suitably controlled by a separate valve. The two pathways join downstream of the valves. The dispense pathway then suitably passes through a single spout that dispenses the beverage at the bottom of the beverage receptacle. An advantage of this approach is that the flow of beverage through the paths is not distorted for example as might be exhibited using a flow restrictor or valve to alter flow rates. Instead, the differing flow resistances are achieved using separate flow paths and so the resistance is spread out over a distance equating to the length of the flow path rather than abruptly at a flow restrictor or valve, which could result in excessive bubbles.

The application will now be described with reference to an exemplary implementation of the beverage dispense device.

Figure 1:
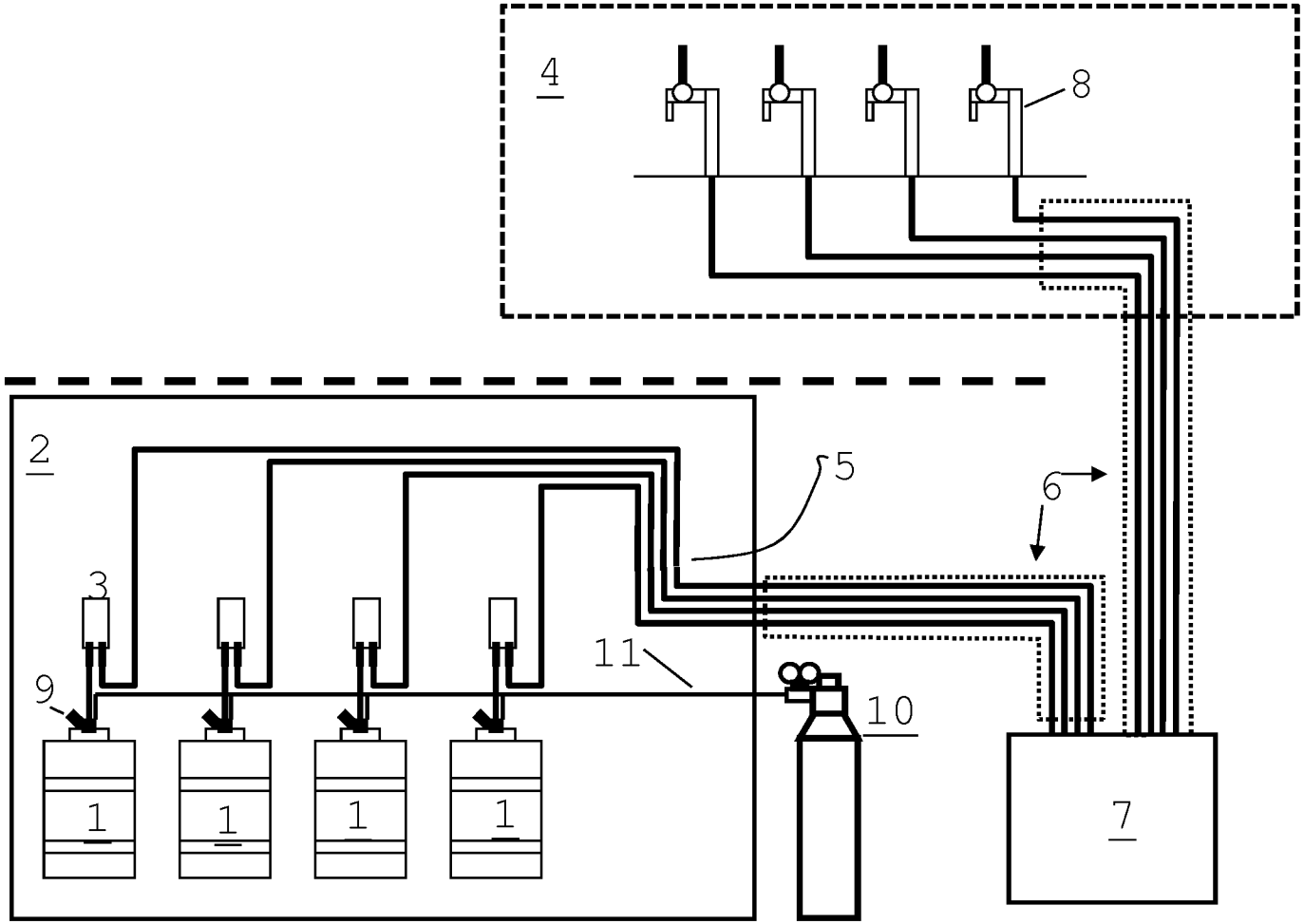
Fig.1 PRIOR ART
FIG. 1 is an exemplary beverage dispense system known in the art.
Figure 2:
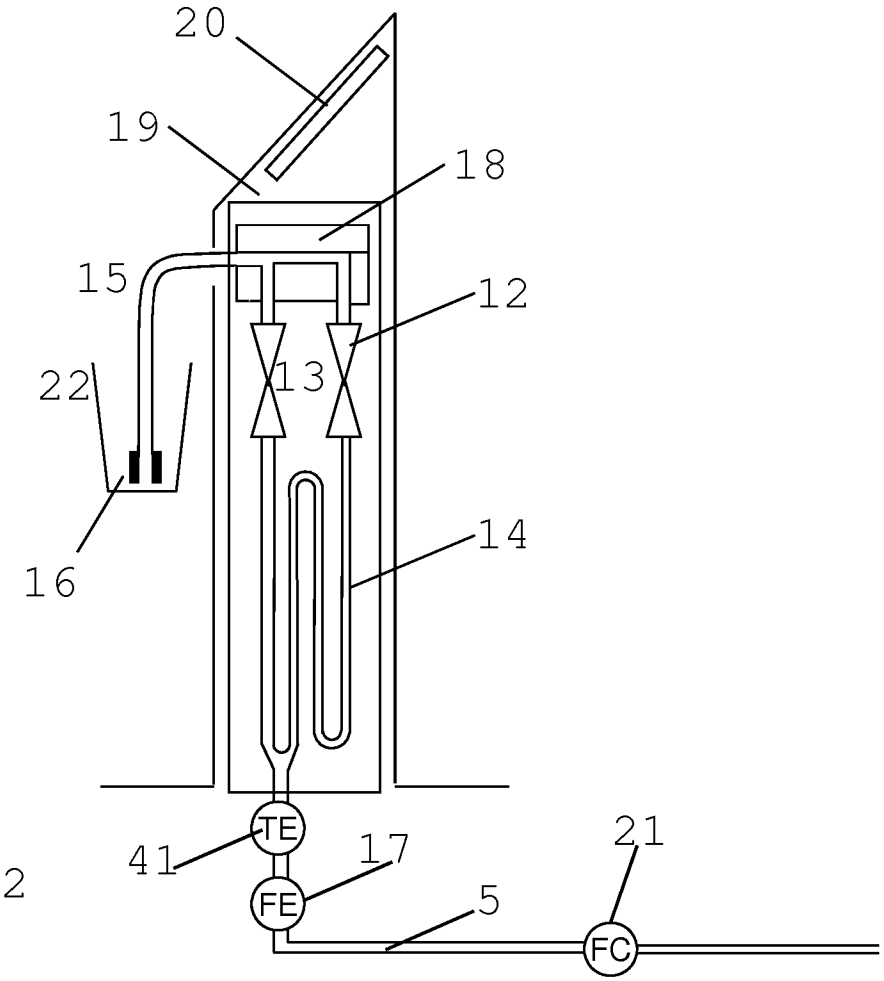
FIG. 2 is an exemplary beverage dispense system according to a first aspect which employs two parallel flow paths to control a dispense process.

More specifically with reference to FIG. 2 and the conventional layout of a bar of FIG. 1, a beverage dispense device is placed conventionally at the end of a beverage conduit 5 in a bar or serving area. In comparison with normal manual dispense methods and in order to provide sufficient supply of beverage, the conduit 5 must have sufficient capacity to deliver the beverage at a high dispense speed. This may require the parallel use of more than one conduit 5 to supply the dispense device or the addition of a pump or similar means to increase the pressure of the delivered beverage or both.

It may also require an increase in any cooling capacity 7 in the dispense system commensurate with the increased dispensed volume of beverage.

The beverage conduit or conduits may include additional components such as a flow controller 21 to control the maximum flow rate of the beverage delivered to the dispense device.

Beverage delivered by the beverage conduit 5 to the dispense device suitably passes through a flow-meter 17 that is used to measure the flow rate of liquid during the dispense process.

This flow-meter may be any suitable type for measurement of flow of a beverage. Suitable examples are turbine or ultrasonic flow-meters.

The measurement output from the flow-meter is provided to a processing device, such as a microcontroller provided in a control panel 20, that controls the dispense process.

At a node downstream, shown downstream of the flowmeter, the beverage flow is split between two paths. Alternatively, but less conveniently, separate flow meters may be provided on each of the two paths.

A temperature sensor 41 may be provided providing a temperature measurement of beverage being dispensed to the microcontroller. As will be explained below, the data from the temperature sensor may be used to change the beverage dispense process.

A first path includes a flow controller 14 and a dispense valve 12 and forms the slow flow path. The flow controller may be of a number of types, in the preferred embodiment it is in the form of a length of beverage conduit with a restricted inner diameter relative to the diameter of the fast flow path. Similarly, the length of the beverage conduit may be longer than that of the fast flow path so as to increase the flow resistance.

The increased frictional resistance from the narrow diameter and length slows the flow of liquid. As the pressure drop is distributed over the length of the slow flow path during dispense, there is less turbulence in the liquid flow. Accordingly, less bubbles form than would if a short length restriction or orifice was used for the same purpose. The slow flow valve 12 may be of a number of types but is typically a solenoid valve of a form that provides minimal disruption to the liquid flow when open. For example a direct acting solenoid valve with an orifice comparable or greater than the diameter of the conduit used in the flow controller. Suitably, the length of the slow flow path is at least 20 cm. The length of the slow flow path will depend on the pressure and diameter of the pipe and other factors, but may be up to 200 cm to distribute the pressure drop over a sufficient distance. Where a different cross sectional area is employed to achieve or partially achieve an increased flow resistance along the length of the first pathway, the change in cross sectional area may be gradual rather than abrupt to avoid creating a turbulent flow. In this context, the change may occur over a length of between 1 and 10 cm.

The second flow path is the fast flow path and is controlled by a high flow valve 13. The high flow valve may be of a number of types and typically is an indirect or pilot operated solenoid valve but may also be a direct acting solenoid valve. The valve is specified to minimise the disruption to the flow when open.

It will be appreciated that other valve arrangements are possible. As an example, a first valve may be provided which switchably connects the fluid dispense path between the slow flow and fast paths with a second valve acting as an on/off valve for the dispense process. In another variation, no valve is provided for the slow path and a first valve is provided opening or closing the fast path is provided with a second valve acting as an on/off valve for the dispense process.

However, as explained above it is desirable that the valves employed act merely to switch on and off flows and do not act as flow restrictors which might introduce undue turbulence.

Returning to the arrangement in FIG. 2, both fast and slow flow paths recombine together at a second node in a manifold 18 downstream of the valves. Beverage exits the manifold and enters a spout 15. Beverage enters the beverage receptacle 22 through the exit orifice 16 of the spout. The spout is suitably of a type and size to allow bottom filling. In its simplest form, this means a spout which has a sufficient length so that the exit orifice may be positioned close to the bottom of a drinks receptacle, for example less than 5 cm from the bottom.

Figure 3:
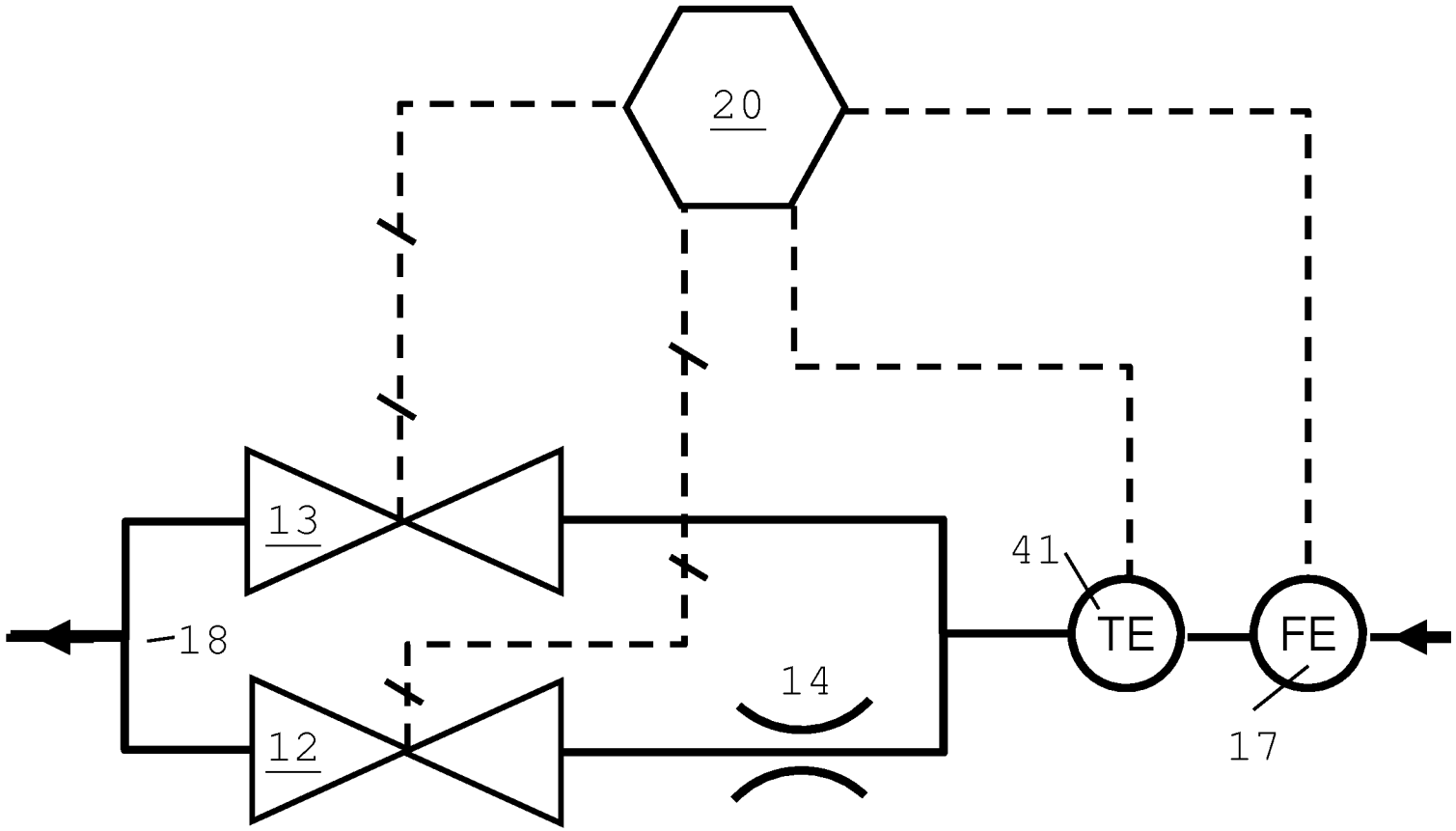
FIG. 3 is an exemplary piping and instrumentation diagram (P&ID) schematic diagram of a beverage dispense device such as shown in FIG. 2.

The components of the dispense device transporting the beverage may be enclosed in insulation 19 to maintain the temperature of the beverage transported along the beverage conduit and through the dispense device. Typically inside the insulation there may also be a recirculated cooling loop (not shown) to maintain the temperature when beverage is not being dispensed. A control panel 20 may be provided on the beverage dispense device allowing a user to send commands to the processor controlling the dispense process. This arrangement is illustrated in the arrangement of FIG. 3, which present the control panel as being connected to the respective flow and temperature sensors 17, 41 and fast and slow valves 13, 12.

Figure 4:
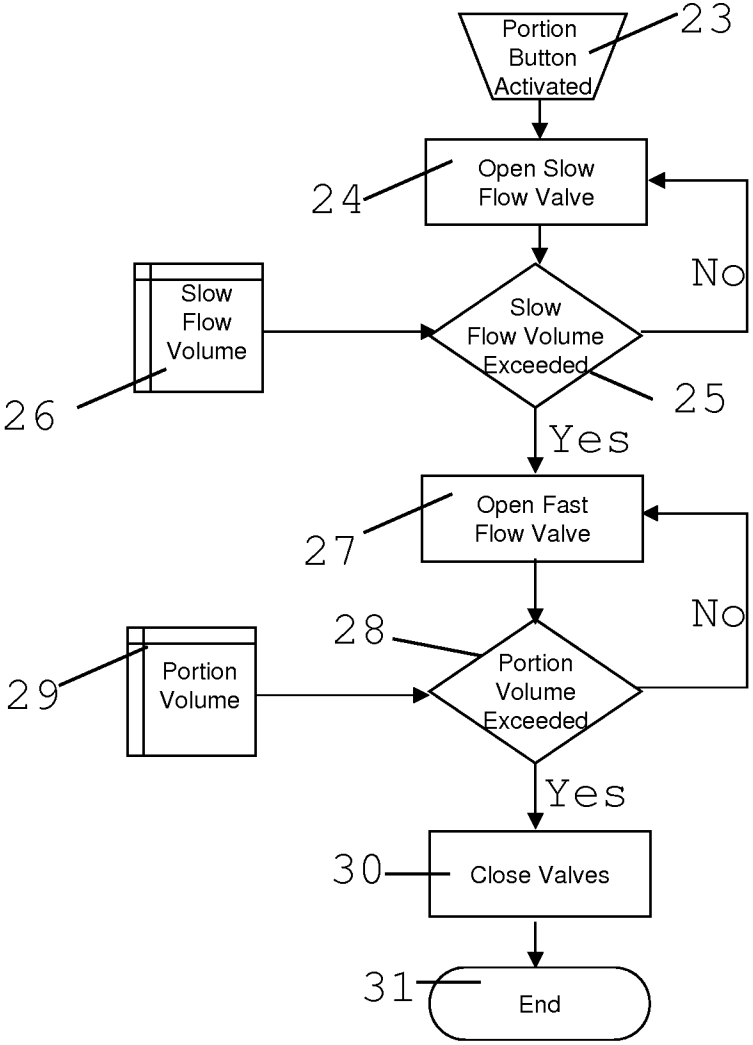
FIG. 4 is a flowchart for the operation of an exemplary dispense device as shown in FIG. 2.

The operation of the beverage dispensing system will now be described with reference to an exemplary dispense process as shown in FIG. 4. The process commences with a user indicating 23 that they wish dispensing of a beverage from the dispense tap. Suitably, this step indicates the portion (dispense volume) required. Initially both the slow and fast valves are closed, i.e. no beverage is flowing. A first step involves opening 24 the slow flow valve to allow beverage to flow through the first path, manifold and out of the spout orifice into a waiting beverage receptacle, such as a glass. This continues until a predetermined condition 26 has been met 25. This condition is intended to equate to a condition where it is possible to switch to fast dispensing, i.e. where the dispense orifice of the spout is sufficiently submerged in beverage.

The predetermined condition may be determined, for example, by measuring with the flow-meter and allowing a predetermined volume, i.e. a "slow flow volume" of beverage to be dispensed. Alternatively, an estimate of the volume may be equated by using a predetermined duration as a condition. Similarly, a level may be physically detected by a level detector provided on the spout identifying when the orifice of the spout is sufficiently submerged.

Once the predetermined condition has been met the fast flow valve is opened 27 and dispense continues until a condition is reached 28 where the required dispense volume 29 has been dispensed. At which point, both valves are closed 30 and the process ends 31 with the refreshing beverage provided to the customer.

It will be appreciated that it is also possible to only use the fast flow path for the second part of the dispense process and to close the slow flow vale at this stage.

Similarly, both valves may be left open initially during the fast dispense and one or other of the two valves may be closed in advance of the dispense volume being reached allowing for a more settled flow as the dispensing is finished. Again, this may be controlled by means of measurements from the flow sensor or by timing.

The microcontroller may accept inputs on the control panel 20 from a bartender through various buttons or switches to allow a number of different portion sizes (dispense volumes) to be dispensed, these may for example include imperial measures of a glass (half pint) and pint and a larger measure equating to a pitcher which may equate to 4 pints. These switches may be provided adjacent to or incorporated into the dispense tap apparatus, commonly referred to as a font.

The predetermined condition may change depending on the selected dispense volume. More particularly, it will be appreciated that the spout orifice may require to be submerged further in a larger receptacle such a pitcher.

Other sensors may be provided. For example, a temperature sensor 41 may be provided to provide measurements of temperature to which the microcontroller may be configured to respond. The temperature sensor is suitably positioned at a location close to the dispense tap, so that it is reflective of the temperature of the beverage being dispensed rather than the temperature of the beverage leaving the storage area. In the arrangement shown in FIG. 2, the temperature sensor is positioned before the beverage supply lines split into first and second paths.

As an example, the measured output of the temperature sensor may be used to change the dispense parameters. For example by increasing the volume dispensed through the slow flow path in excess of a normal predetermined volume if the measured temperature increases above a predetermined level. Similarly, the dispense process could also be halted if the beverage temperature exceeds a specified value.

The microcontroller may also be configured to change dispense parameters in response to other factors.

For example, the microcontroller may be configured to alter the slow dispense time in response to the length of time since the previous dispense was completed. For example by increasing the volume dispensed through the slow flow path in excess of the predetermined volume in response to increased time duration since the previous dispense. This ensures that any drain down of residual liquid from the manifold and spout is compensated for and there is both sufficient volume in the receptacle and all air or gas has been removed from the dispense spout, before the fast flow valve opens.

Figure 5:
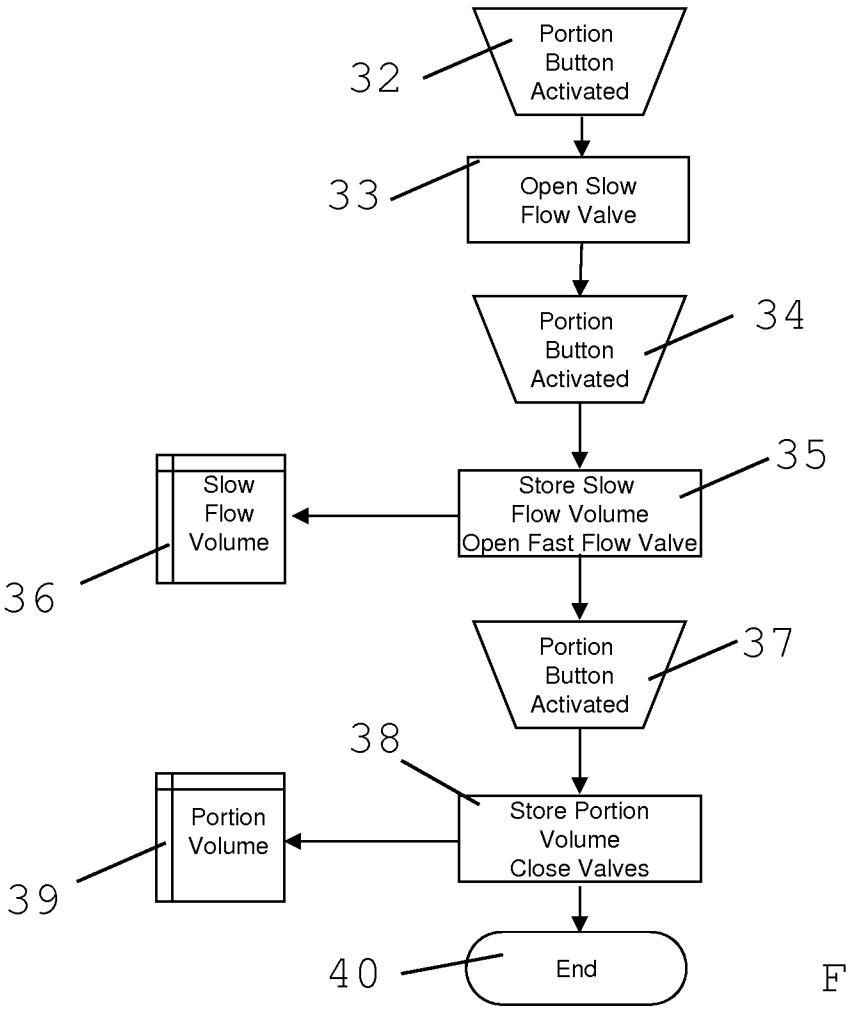
FIG. 5 is a flowchart for the portion calibration of an exemplary dispense device.
Figure 6:
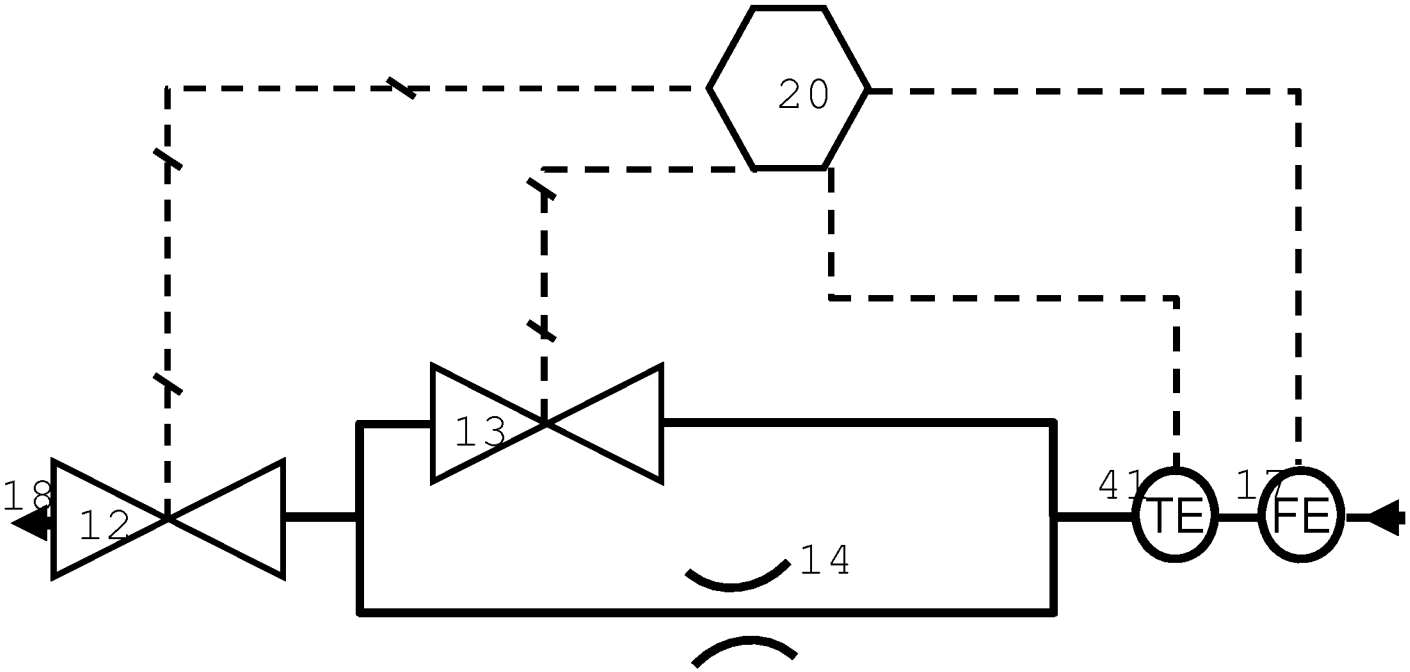
FIG. 6 is another exemplary piping and instrumentation diagram (P&ID) schematic diagram of the beverage dispense system of FIG. 2.

It will be appreciated that repeatability is an important criteria in implementing a system such as this in a bar. At the same time, it will be appreciated that there will be factors which can affect the dispense process including for example the pressures, accuracy of the flow meters, size of drinks receptacles. Accordingly, a calibration process may be employed after an initial installation or where parameters in the system are changed. An exemplary portion volume calibration flowchart is presented in FIG. 5. The calibration process is relatively simple and responds to a number of user inputs. In one simple form, the calibration process may be entered for example by means of a key switch or similar device. Once in the calibration process, the activation of a selected portion button 32 opens the slow flow valve 33. A second activation of the selected portion button 34 records the slow pour volume 36 and causes the fast pour valve 35 to open. A third activation of the selected portion button 37 closes all valves 38 and stores the portion volume 39. After which, the calibration process is finished 40 for the selected portion button. The process may be repeated for other portion buttons, e.g. corresponding to half pint, pint and pitcher portions.

Equally, it will be appreciated that the process for a particular portion may be repeated a number of times and average values taken for the slow dispense volume and dispense volume.

Whilst volume measurements are desirable to ensure an accurate dispensing of liquids, it will be appreciated that time measurements may be employed in place of volume measurements, e.g. measuring the duration required for the first valve to be opened and then for the second valve to be opened. Equally, a combination of time and volume measurements might be used. For example, the duration of the slow dispense process might be determined based on time, with a volume measurement used to ensure the correct overall volume of beverage is dispensed into a receptacle.

It will be appreciated that whilst several different embodiments have been described herein, that the features of each may be advantageously combined together in a variety of forms to achieve advantage.

Whilst reference has been made above to a single tap, i.e. a single spout filling a single glass. The arrangement may also be used multiple tap for filling multiple glasses concurrently. It will be appreciated that each spout of such an arrangement may be a bottom-fill spout. If there are 5 spouts then 5 individual glasses are placed below a corresponding spout. As above, two or more flow paths may be provided to achieve the two step filling process. It will be appreciated that a number of combinations are possible. For example, each spout may have a separate slow dispense path with a common fast dispense path provided generally which splits at a junction prior to each spout. Equally, the opposite may be true, i.e. that each spout may be fed by a separate fast dispense path with a common slow dispense path provided a common feed to each of the spouts which splits at a junction prior to each spout. Similarly each spout may have an individual slow and fast flow path associated with it.

In the foregoing specification, the application has been described with reference to specific examples of embodiments. It will, however, be evident that various modifications and changes may be made therein without departing from the broader spirit and scope of the invention as set forth in the appended claims. For example, the fluid conduits, e.g. pipes and lines, may be any type of conduit suitable to transfer a fluid one location to another.

Other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps than those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A system for dispensing a carbonated beverage from a beverage source through a dispense tap having a spout having an outlet, wherein the spout is configured for bottom filling of a beverage receptacle, the system comprising:

a common path for carrying beverage from the beverage storage container to a first node;

a first path comprising a first conduit for carrying beverage from the first node to the spout;

a second path comprising a second conduit for carrying beverage from the first node to the spout, a valve arrangement actuable to allow beverage to flow through one or other or both the first and second paths;

wherein the first path has a higher flow resistance than the second path, wherein the valve arrangement is positioned at the opposite end of the first and second paths to the first node.

2. A system according to claim 1, wherein the first and second flow paths are fluidly connected to a common fluid outlet of the spout.

3. A system according to claim 1, wherein the first and second flow paths are fluidly connected to separate fluid outlets of the spout.

4. A system according to claim 1, wherein the higher flow resistance is a result of using one or both of a) a reduced cross sectional area along the first conduit compared to the cross sectional area of the second conduit; or b) a longer length of the first conduit with respect to the second conduit, such that the higher flow resistance is distributed substantially uniformly over the length of the first conduit so as to limit turbulent flow.

5. A system according to claim 1, wherein the flow rate of beverage through the first path is between 0.4 l/min and 3.5 l/min.

6. A system according to claim 1, wherein the flow rate of beverage through the second path is between 4 l/min and 12 l/min.

7. A system according to claim 1, wherein the ratio of flow rates in the first flow path and the second flow path is in the range 2 to 10.

8. A system according to claim 1, wherein there are a plurality of dispense taps, each tap having an associated common path, first path and second path.

9. A system according to claim 1, wherein the flow rate for a given pressure in the second path is at least twice that of the flow rate in the first path.

10. A system according to claim 9, wherein the flow rate of beverage through the first path is approximately 2 l/min.

11. A system according to claim 10, wherein the flow rate through second path is approximately 7.5 l/min.

12. A system according to claim 1, further comprising:

a controller for operating the valve arrangement wherein the controller is configured when filling the beverage receptacle to initially cause the valve arrangement to allow beverage to flow through the first path.

13. A system according to claim 12, wherein the controller is configured to operate the valve arrangement so that beverage can flow through the second path after a predetermined condition has occurred after flow has commenced through the first path.

14. A system according to claim 13, wherein the predetermined condition is an elapsed time from commencement of flow through the first path determined by the controller.

15. A system according to claim 13, wherein the predetermined condition is dependent on one or more of the following:

a) the elapsed time since the previous dispense, and b) the temperature of the beverage measured by a temperature sensor.

16. A system according to claim 13, wherein the predetermined condition is that a level of the beverage in the receptacle is raised to a height in the range of 1 cm to 6 cm above the outlet of the spout when the spout is placed at the bottom of the receptacle.

17. A system according to claim 13, wherein the predetermined condition is the flow of a predetermined volume through the first path.

18. A system according to claim 13, wherein the predetermined condition is the detection of a liquid level about the spout.

19. A system according to claim 13, wherein the predetermined condition is dependent on an input received from a user at an input device.

20. A system according to claim 19, wherein the input received is indicative of the size of a beverage receptacle being used.

21. A system according to claim 20, wherein the input device comprises a plurality of buttons, each button being associated with a different size of beverage receptacle.

22. A method of bottom filing a beverage receptacle comprising:

providing a bottom fill spout into a beverage receptacle;

operating a first valve to commence providing a beverage through a first flow path to the bottom fill spout;

operating a second valve to commence providing the beverage through a second flow path to the bottom fill spout after the level of beverage in the beverage receptacle is above an outlet of the spout wherein the first valve is positioned between the first flow path and the bottom fill spout and the second valve is positioned between the second flow path and the bottom fill spout, wherein the first flow path has a higher flow resistance than the second flow path as a result of using one or both of a) a reduced cross sectional area along a first conduit at least partially defining the first flow path compared to the cross sectional area of a second conduit at least partially defining the second flow path; or b) a longer length of the first conduit with respect to the second conduit, such that the higher flow resistance is distributed substantially uniformly over the length of the first conduit so as to limit turbulent flow.

* * * * *